United States Patent [19]

Rehkemper et al.

[11] 4,412,682

[45] Nov. 1, 1983

[54] ACTION GAME DEVICE

[75] Inventors: Steven F. Rehkemper, Chicago; Howard J. Morrison, Deerfield, both of Ill.

[73] Assignee: Marvin Glass & Associates, Chicago, Ill.

[21] Appl. No.: 347,534

[22] Filed: Feb. 10, 1982

[51] Int. Cl.[3] ..... A63F 7/00

[52] U.S. Cl. ..... 273/1 GG

[58] Field of Search ..... 273/1 GG, 1 GC, 1 GD, 273/1 GF; 221/210

[56] References Cited

U.S. PATENT DOCUMENTS

| | | | |
|---|---|---|---|
| 853,977 | 5/1907 | Inman | 221/210 X |
| 872,653 | 12/1907 | Hart | 221/210 X |
| 2,112,448 | 3/1938 | Port | 221/210 X |
| 2,985,451 | 5/1961 | Sims | 273/1 GF |
| 3,578,319 | 5/1971 | Kohner et al. | 273/1 GG |
| 3,721,440 | 3/1973 | Burns | 273/1 GG |
| 4,177,987 | 12/1979 | Zimmerman | 273/1 GG |

FOREIGN PATENT DOCUMENTS

| | | | |
|---|---|---|---|
| 662305 | 4/1964 | Italy | 221/210 |

*Primary Examiner*—Paul E. Shapiro

[57] ABSTRACT

An action game device, in which the participants attempt to transfer objects from a receptacle to a receiver as quickly as possible, includes a pair of manually manipulatable elongate members for each player communicating with the receptacle through ports in upstanding barriers located on opposite sides of the receptacle. The ports constrain the freedom of movement of the elongate members according to their size. One end of each member is arranged to engage the objects located within the receptacle and the other end, located on the opposite side of an upstanding barrier, is arranged to be manually manipulated by the user. A receiver for the objects is located atop each upstanding barrier, generally positioned intermediately between each player's elongate members. The receiver includes an aperture, a backboard for the aperture, and a generally horizontally arranged guide for guiding the objects into the aperture. A collection tub is located beneath the aperture for receiving the objects collected.

12 Claims, 3 Drawing Figures

ACTION GAME DEVICE

BACKGROUND OF THE INVENTION

1. Field of the Invention

This invention relates generally to action games and particularly to games of the type where the players attempt to collect a plurality of objects as quickly as possible, constrained by the game apparatus to make the collection more difficult.

2. Background of the Invention

Games that transform generally simple tasks into awkward, more difficult challenges are well known and provide considerable entertainment by engendering both competition and concentration in an amusing situation. Such games also provide enjoyment for those watching these awkward contests. Included in the well known games of this type are apple bobbing, tiddly winks, and pin the tail on the donkey. While these perennial favorites have developed considerable entertainment success over many generations, there is a continuing demand for new and more stimulating games of this type.

SUMMARY OF THE INVENTION

It is the primary object of the present invention to provide an amusing and stimulating competitive game requiring active participation by its players.

This and many other objects and advantages of the present invention are achieved by an action game device including a plurality of objects and an object receptacle for those objects. A manually manipulatable elongate member includes one end capable of engaging at least one of the objects and another end capable of being manipulated by the user. Means are provided for limiting the range of movement of the member to make the game more challenging. A receiver for the objects is spaced from the object receptacle and arranged to allow the objects to be transferred into the receiver from the receptacle by the member.

DETAILED DESCRIPTION OF THE PREFERRED EMBODIMENT

Figure 1:
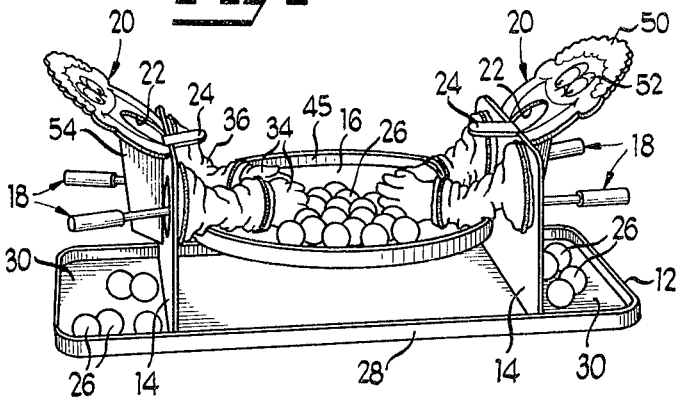
FIG. 1 is a perspective view of one embodiment of the present invention.

Referring to the drawing wherein like reference characters are used for like parts throughout the several views, an action game device, generally designated by the reference numeral 10 and shown in FIG. 1, includes a tray 12, a pair of upstanding barriers 14 connected at spaced points, generally perpendicularly, to the tray 12, an object receptacle 16 supported between the upstanding barriers 14, and a pair of player manipulatable elongate members 18. The members 18 conveniently have the appearance of human arms and an object receiver 20, located above each barrier 14, conveniently has the appearance of a human head with a mouth or aperture 22 and an outwardly directed, slightly upwardly inclined tongue or tab 24 adjacent the aperture 22. Thus, the combination of the pair of members 18, the barrier 14 and the receiver 20 produces a humanoid appearance. While a wide variety of objects may be used in implementing the game device 10, the spherical objects 26, illustrated in FIG. 1, are highly useful for this purpose, and specifically conventional plastic marbles are suitable for this application.

The conveniently flat tray 12 includes a peripheral upstanding rim 28. A pair of spaced object retainers 30 are defined on the tray 12 by the imposition of the upstanding barriers 14, which conveniently extend completely across the tray 12.

Figure 2:
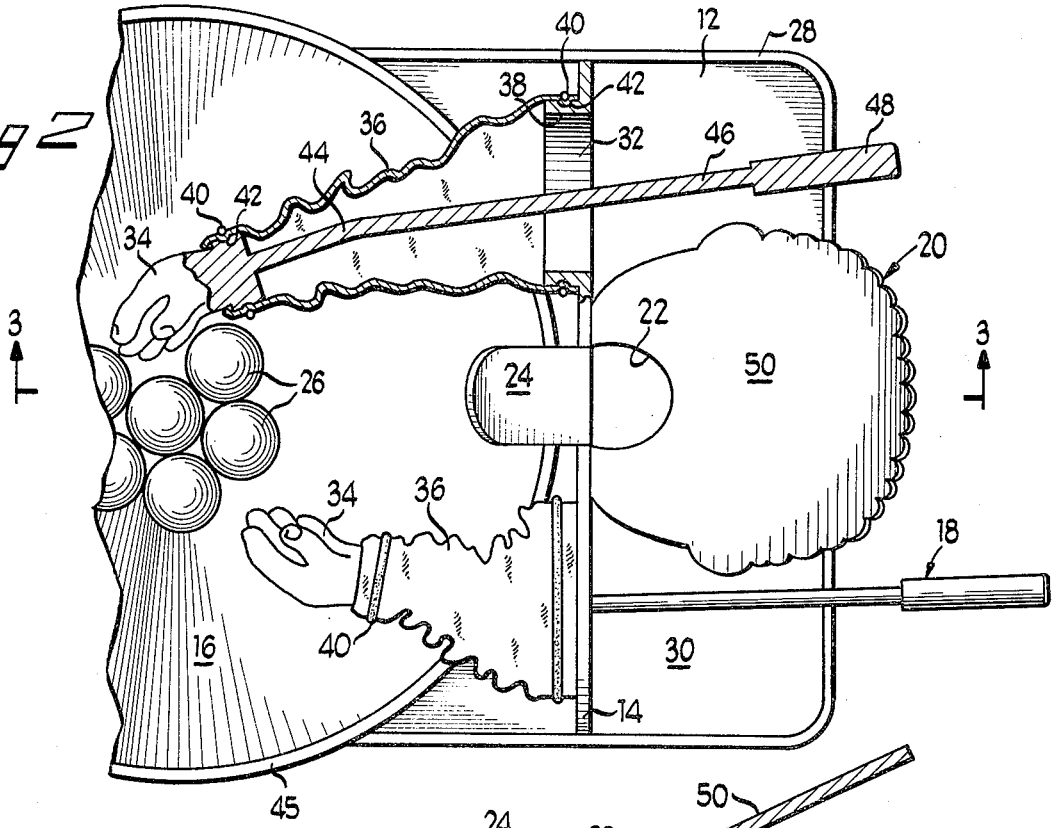
FIG. 2 is a partial, partially sectioned enlarged view of the embodiment shown in FIG. 1.

The upstanding barriers 14 each include a pair of side by side ports 32, located above the receptacle 16 as shown in FIG. 2, and one elongate member 18 extends through each port 32. One end of each member 18 includes an object grasping portion 34 which extends sufficiently into the receptacle 16 to engage the objects 26 therein. In the illustrated embodiment, the object grasping portion 34 is in the form of a cupped human hand. A flexible sleeve 36, conveniently made of cloth or the like, is connected on one end to the portion 34 and on the other end to an annular rim 38 surrounding each port 32 so that the portion of the member 18 extending over the receptacle 16 has the appearance of a human arm. The sleeve 36 is retained on each end by a resilient band or ring 40 which forces the end portions of the sleeve 36 into underlying grooves 42 in each case. A portion of each member 18 extending over the receptacle 16 includes a bend 44 which makes it possible to bring the two portions 34 of a pair of members 18 extending through one barrier 14 together so as to grasp an object 26 more easily. A user manipulatable end 46 of each member extends outwardly from the opposite side of the barrier 14 and includes a handle 48 at its free end.

The receptacle 16, illustrated as generally circular although any desired configuration may be utilized, includes an upstanding peripheral rim 45. The receptacle 16 is supported by the barriers 14 at a point intermediate along the length of each barrier 14. The dished center of the receptacle 16 encourages the objects 26 to collect at a location equally accessible to all players using the members 18 extending through either barrier 14. In addition the curved or circular shape of the receptacle 16 avoids dead spots where the objects 26 may be trapped.

Figure 3:
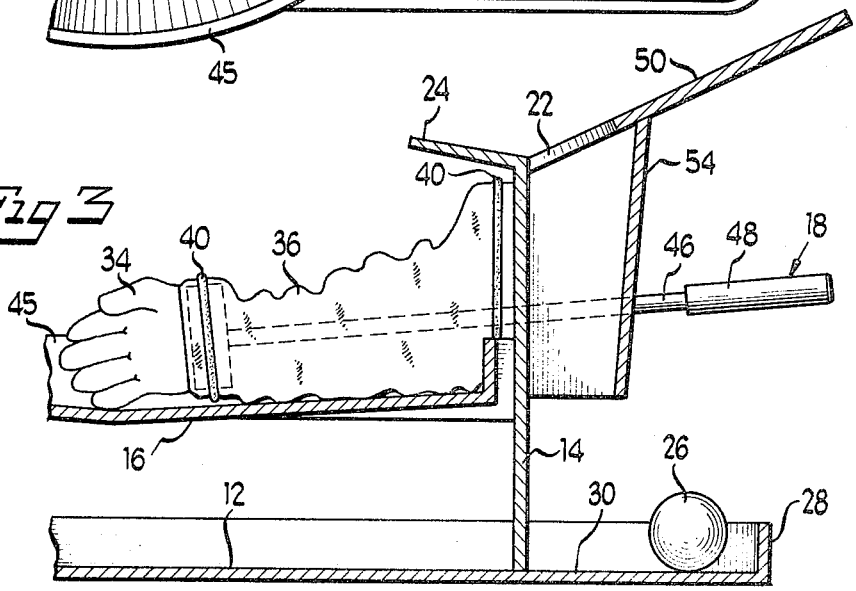
FIG. 3 is a cross-sectional view taken generally along the line 3—3 in FIG. 2.

The object receiver 20 includes a backboard portion 50 angled away from the receptacle 16 and conveniently covered with indicia 52 lending the appearance of a human face. The aperture 22 in the backboard portion 50, conveniently located centrally between the ports 32, may be accessed by the elongate members 18 so that a ball or object 26 may be deposited through the aperture 22 with the aid of the outstanding tongue or tab 24. As shown in FIG. 3, a tube 54 extends downwardly from the aperture 22 so that objects 26 inserted through the aperture 22 fall through the tube 54 and are collected within the object retainer 30 located beneath the tube 54.

In accordance with one exemplary manner of playing the game, a plurality of objects 26, positioned in the receptacle 16, collected generally at the center thereof. Each player, located on opposite sides of the tray 12, manipulates a pair of elongate members 18 associated with one barrier 14 to lift the objects 26 from the receptacle 16, depositing them through the aperture 22. Thus each player's collected objects 26 are stored in a distinct object retainer 30 assigned to that player so that each player can determine the number of objects collected. The winner is a player who collects the most objects 26.

The elongate members 18 may be manipulated by twisting their ends 46 to rotate the portion 34 beneath an object 26 or the members 18 can be turned inwardly trapping an object 26 between the pair of opposed portions 34 in a pincer action. In any case the appropriate members 18 are then pivoted upwardly and retracted out of the region between the barriers 14 in a direction toward the object receiver 20. The objects 26 are then deposited on the tab 24 and pushed through the aperture 22, the angling of the backboard 50 ensuring that the backboard portion 50 does not interfere with the access to the aperture 22.

In this way the game progresses with each player manipulating arm-like appendages to insert objects through an elevated mouth-like opening in a feeding or face stuffing action. The user can attempt a variety of techniques for grasping the objects as quickly as possible. However, the size of the ports 32 limits the freedom or range of motion of the members 18 making it somewhat awkward to manipulate the objects 26 and lending additional challenge to the game. At the same time this inherent awkwardness adds amusement for both the players and the observers.

While this invention has been described with respect to a single preferred embodiment, a variety of modifications will be obvious to those skilled in the art and it is intended within the appended claims to cover all such modifications as are within true spirit and scope of the present invention.

What is claimed and desired to be secured by Letters Patent of the United States is:

1. A game apparatus comprising:

a plurality of objects;

an object receptacle for said objects;

a manually manipulatable elongate member, including one end capable of engaging one of said objects and another end capable of being manipulated by the user;

means for limiting the range of movement of said member including an upstanding barrier adjacent said receptacle, said barrier including a port for permitting said member to extend through said barrier into communication with said receptacle and a flexible sleeve connected on one end to the member adjacent the end of the member capable of engaging one of said objects and connected on the other end to the barrier around said port; and a receiver for said objects spaced from said object receptacle and arranged to allow said objects to be transferred to said receiver from said receptacle with said member.

2. The game apparatus of claim 1 wherein said objects are spheres.

3. The game apparatus of claim 1 wherein said object receptacle is a generally circular tray.

4. The game apparatus of claim 3 wherein said object receptacle has a central depression.

5. The game apparatus of claim 1 including a pair of members and wherein said barrier is substantially planar with a pair of side by side ports extending through said barrier.

6. The game apparatus of claim 5 including a pair of upstanding barriers located on opposite sides of said receptacle, each with a pair of side by side ports for said members, and further including two pairs of said members.

7. The game apparatus of claim 5 including a bend intermediate the ends of each member to facilitate grasping of said objects by the pair of members.

8. The game apparatus of claim 1 wherein said object grasping end of said member is a facsimile of a human hand.

9. The game apparatus of claim 1 wherein said receiver includes an aperture located in a position spaced above said receptacle and an outwardly extending tab means for guiding said objects into said aperture.

10. The game apparatus of claim 1 wherein said receiver includes a backboard plate angled upwardly and away from the receptacle with an aperture located near the bottom of the plate for receiving said objects for guiding said objects into said aperture or back into said receptacle.

11. The game apparatus of claim 10 wherein said plate is in the shape of a human head and said aperture is located in the position of the human mouth.

12. The game apparatus of claim 10 including a retainer for the objects spaced from the receptacle and from the receiver with a tube extending downwardly from the aperture to direct objects deposited in the aperture into the retainer.

* * * * *

UNITED STATES PATENT AND TRADEMARK OFFICE

CERTIFICATE OF CORRECTION

PATENT NO. : 4,412,682

DATED : November 1, 1983

INVENTOR(S) : Steven F. Rehkemper et al.

It is certified that error appears in the above-identified patent and that said Letters Patent is hereby corrected as shown below:

Column 2, line 60, "collected" should read -- collect --.

Signed and Sealed this

*Fifth* Day of *June 1984*

[SEAL]

*Attest:*

GERALD J. MOSSINGHOFF

*Attesting Officer*

*Commissioner of Patents and Trademarks*